US006625814B1

(12) United States Patent
Veh

(10) Patent No.: US 6,625,814 B1
(45) Date of Patent: Sep. 30, 2003

(54) PROTECTIVE VEST

(75) Inventor: Peter Karl Veh, Lindau-Bodensee (DE)

(73) Assignee: Neil Pryde Limited (HK)

( * ) Notice: Subject to any disclaimer, the term of this patent is extended or adjusted under 35 U.S.C. 154(b) by 0 days.

(21) Appl. No.: 09/705,220

(22) Filed: Nov. 2, 2000

(51) Int. Cl.[7] ..... A41D 1/04
(52) U.S. Cl. ..... 2/102; 428/116
(58) Field of Search ..... 2/465, 456, 2.15, 2/462, 463, 467, 2.5, 69, 93, 94, 97, 102, 108, 247–252, DIG. 1; 428/911, 114, 116; 442/46, 134–136, 32, 301, 414

(56) References Cited

U.S. PATENT DOCUMENTS 4,870,706 A * 10/1989 Ketcham et al. ..... 2/456
5,477,558 A * 12/1995 Volker et al. ..... 2/456
5,495,620 A * 3/1996 Schoenweiss et al. ..... 2/2.5
5,591,933 A * 1/1997 Li et al. ..... 89/36.02
5,601,907 A * 2/1997 Matsumoto ..... 441/1
6,103,641 A * 8/2000 Gehring ..... 442/46
6,125,645 A * 10/2000 Horn ..... 62/259.3

* cited by examiner

*Primary Examiner*—Tejash Patel
(74) *Attorney, Agent, or Firm*—Jackson Walker L.L.P.

(57) ABSTRACT

A sailor's vest is provided with externally exposed padding A formed by an open sieve like mattress. This padding serves to reduce or absorb impacts experienced if the sailor falls into water at high speed, for example. The vest has pockets for slidingly receiving and holding respective body support modules.

8 Claims, 3 Drawing Sheets

PROTECTIVE VEST

BACKGROUND OF THE INVENTION

1. Field of the Invention

The invention relates to a protective vest.

2. Description of Prior Art

The invention relates more particularly to a protective vest that has a particular use by yaghtsmen and sail board sailors. Such vests are known and often contain in-built rigid reinforcing members, padding and straps to support an upper body region of the sailor. The vest may formed as or be attached to a harness in use.

Broadly stated, presently used protective vests are designed to lessen or absorb some of the forces applied to a sailor's body as he carries out tasks associated with sailing, especially in inclement weather. Thus far, vests that effectively or significantly reduce or absorb impacts caused by waves of water striking the sailor or experienced by the sailor falling into the water at high speed are not available.

SUMMARY OF THE INVENTION

It is an object of the invention to overcome or at least reduce this problem.

According to the invention, there is provided protective vest including significant regions of externally exposed padding comprising an open sieve like mattress formed of resilient water-resistant strands.

The mattress may be generally planar and comprise inner and an outer woven honeycombed layers joined together by a plurality of strands extending laterally between the layers.

Apertures of the honeycombs preferably have effective diameters approximately equal to a lateral separation between the inner and outer layer.

The protective vest may have removable rigid impact modules for reinforcing the vest underneath the exposed padding.

Pockets may be formed in the vest for slidingly receiving the impact modules.

Three modules may be provided respectively for left and right side lumbar regions of a user's body and a central spine region of the vest.

A single belt may be provided for holding the three modules in position in respective pockets of the vest.

BRIEF DESCRIPTION OF THE DRAWINGS

A protective sailor's vest according to the invention will now be described by way of example with references to the accompanying drawings in which:FIG.

DESCRIPTION OF THE PREFERRED EMBODIMENT

Figure 1:
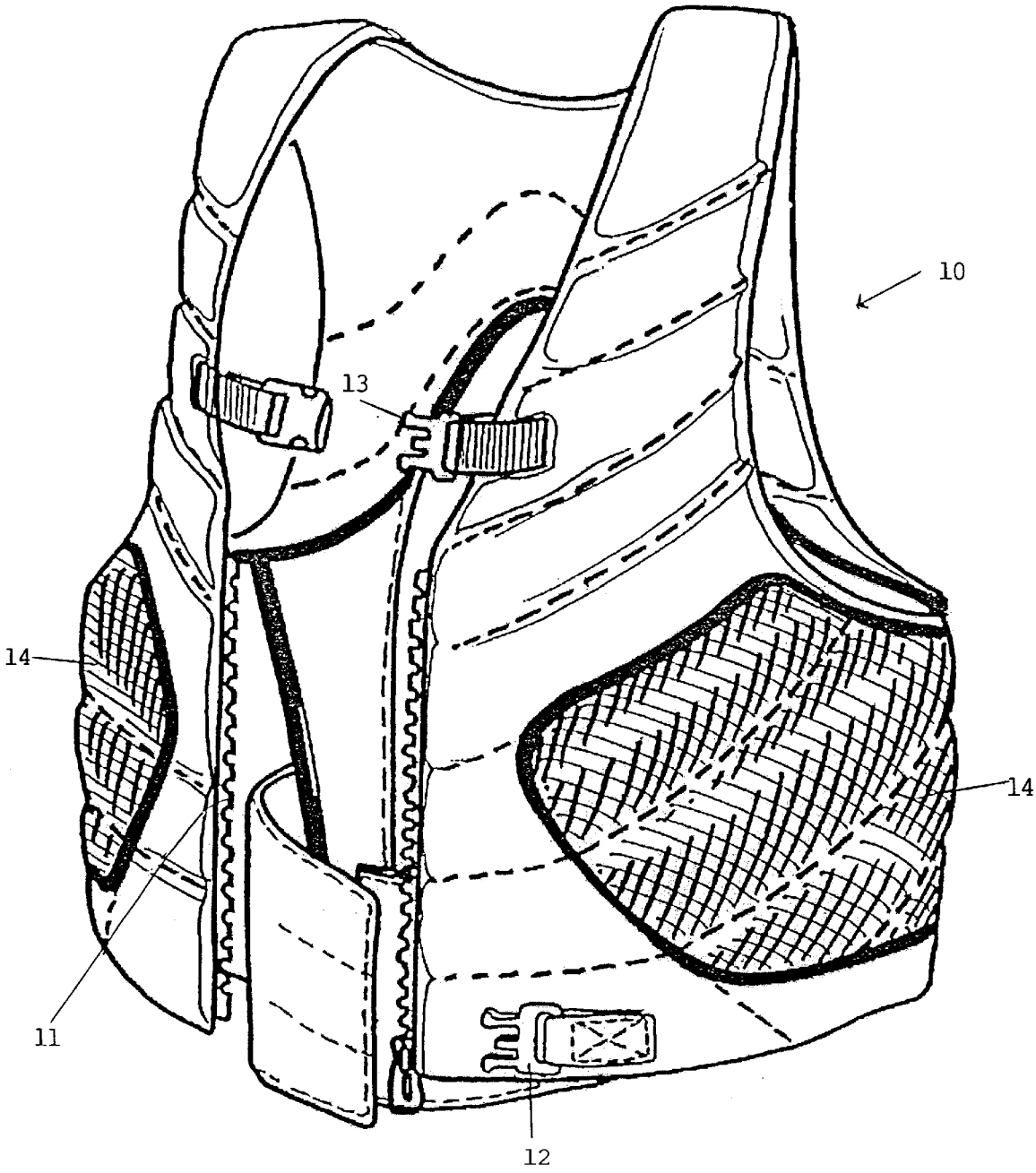
FIG. 1 is an isometric front view of the vest.
Figure 2:
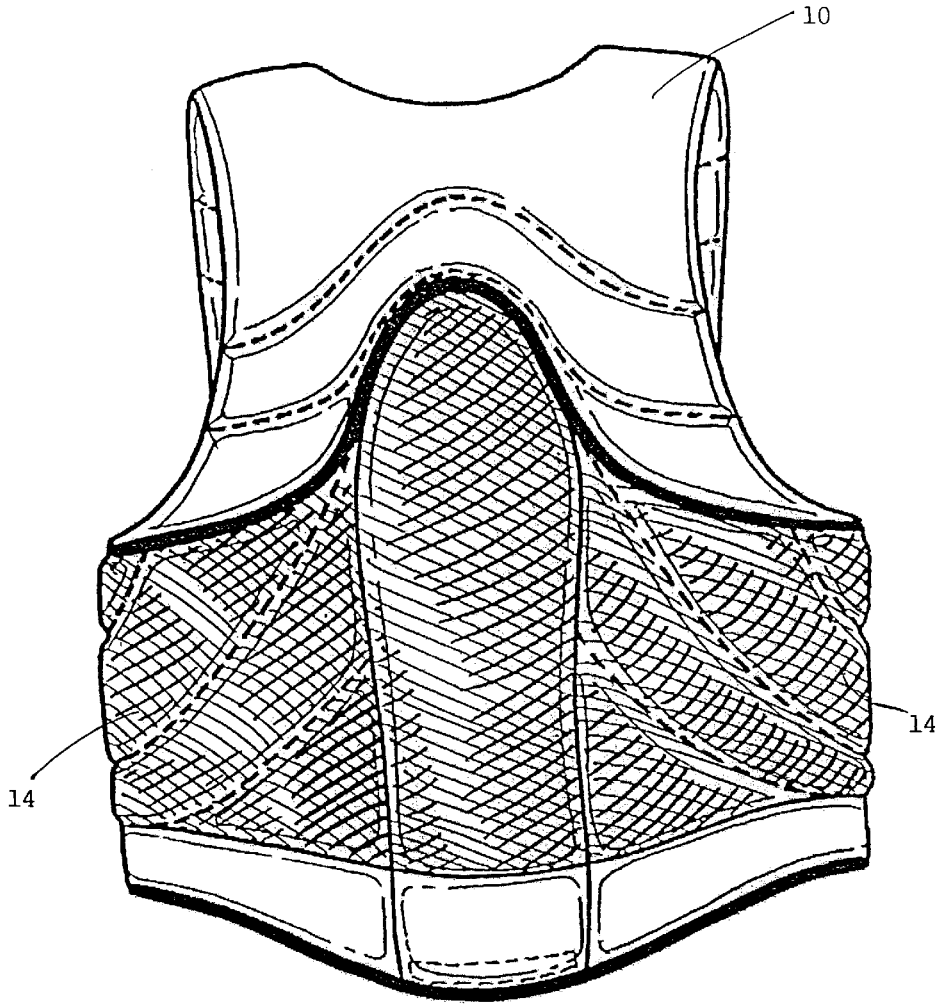
FIG. 2 is an isometric rear view of the vest.
Figure 4:
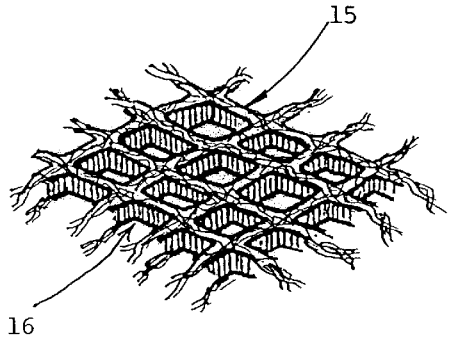
FIG. 4 shows a small piece of mattress used as exposed padding of the vest.

Referring to the drawings, in FIGS. 1 and 2 the sailors vest 10 is of generally conventional shape having a closure zipper 11, and belt buckles 12 and 13. Externally exposed padding or mesh 14 is provided over a significant region of the overall vest outer surface. The padding 14 comprises an open sieve-like mattress, as shown in FIG. 4, with two woven strand honeycomb layers 15 and 16 supported and normally held apart by a plurality of strands. The strands are made of resilient plastics material that is water-resistant. The effective diameters of the honeycombs are approximately equal to the thickness of the mattress.

Such mattresses are generally well-known and make take various similar forms. Hitherto such mattresses have been used in 'protective' clothing, such as for example 'flack jackets' worn by soldiers or policemen. In all known applications the mattress is lined or otherwise enclosed and, in any event does not form an exposed outer layer of clothing. This contrasts with embodiments of the present invention.

The main effect of the 3-D mesh padding is that the open structure on the surface of the vest breaks up the hard surface of the water during the impact. Impact modules (thin plastic boards, see below) plus the padding itself divide the forces over a wide surface. Through that the forces get split up and reduce the forces which directly effect the body of the user. Thus, the padding 14 reduces or absorbs impacts between the sailors body and waves or the surface of water when struck by a wave or falling into or against the water, respectively. The open structure of the padding disperses blocks of water striking against the sailor's body somewhat laterally i.e. along the sieve-like mattress. This significantly reduces impact forces otherwise experienced directly towards the sailor's body. As it is common, particularly for a board sailor, to fall from time to time into the water at high speed or in some manoeuvres to possibly fall into the water from a significant height, reducing the effective impact on his body provides considerable advantages, and/or makes sailing much safer.

Figure 3:
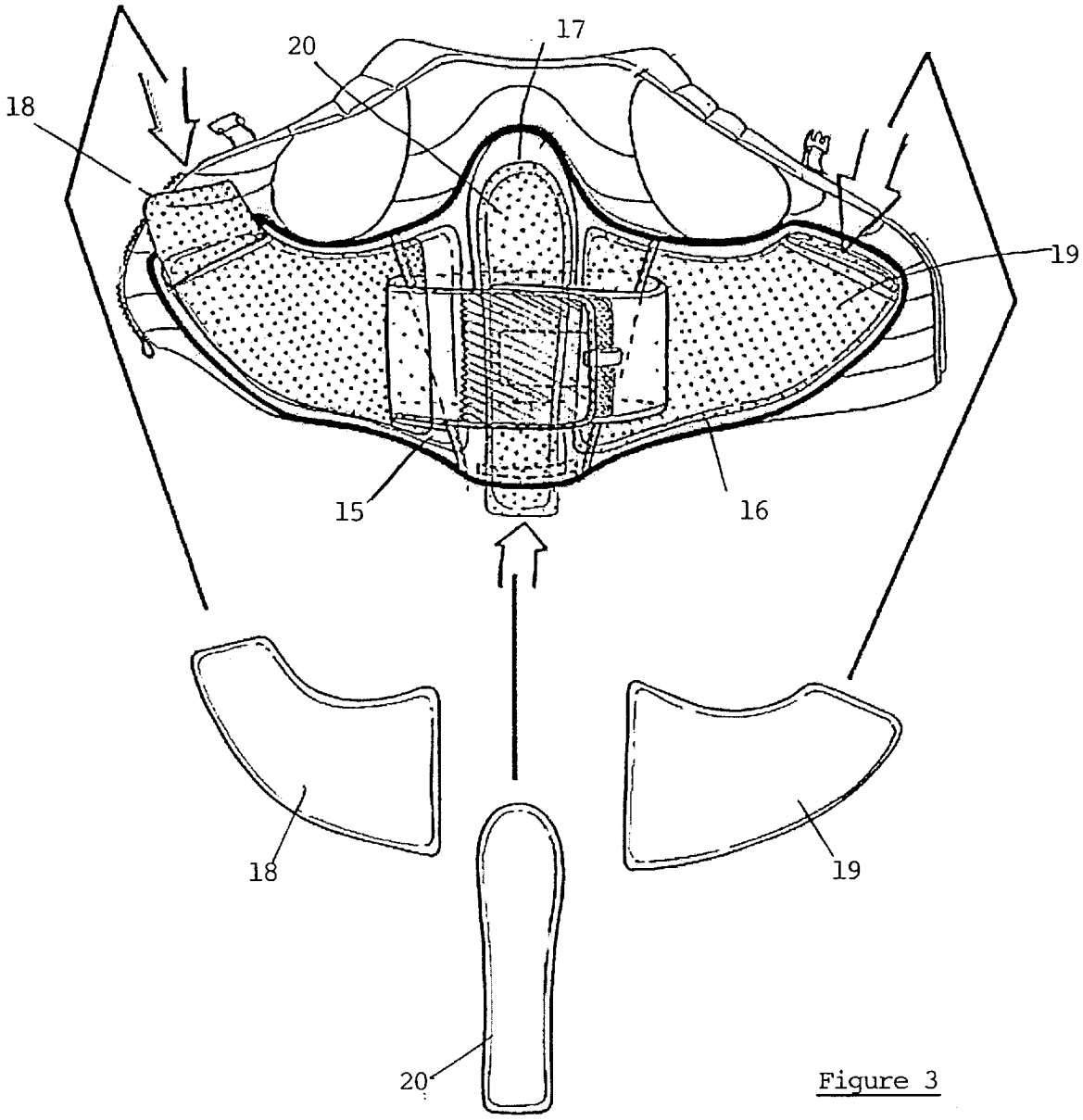
FIG. 3 is an isometric partial rear view of the vest illustrating the insertion and placement of impact modules.

The vest is formed with three pockets 15, 16 and 17 as shown in FIG. 3 for slidingly receiving respective rigid plastic impact modules 18, 19 and 20. The modules 15 and 16 provide lumbar supports and the module 17 is a central spinal support. The modules can be used when required by the sailor and are held in position in use by a single belt 21 in the pockets under the padding 14.

Embodiments of the invention thus comprise vests 10, which could each form a major part of a jacket, that have padding 14 for effectively reducing the force of impacts between the sailor and 'blocks' of water. The vest can further provide protective supports, when required, by inserting impact modules 15, 16 and 17 into the respective pockets. The padding 14 also inherently protects the sailor, to some extent, against impacts by small projectiles, flapping sails or ropes, and so forth. The mattress, being formed as an open structure of water resistant strands, also quickly drains of water after being submersed in water for example and so does not become or remain heavy in normal use.

Whereas the described vests have been developed for use for sailing in particular, such vests may be used for other activities. For example by fireman to reduce body impacts if accidentally sprayed from the high pressure hose, or workmen in an environment where there is a risk of falling 4 or more metres into a body of water. As such, the claims refer to a "protective vest" being more indicative of the characteristic of vests according to the invention, function rather than any particular usage to which the vest have advantageous use.

I claim:

1. A protective vest including significant regions of externally exposed padding comprising an open sieve mattress formed of resilient water-resistant strands, and removable rigid impact modules for reinforcing the vest underneath the exposed padding.

2. A protective vest according to claim 1, in which the mattress is generally planar and comprises inner and outer woven honeycombed layers joined together by a plurality of strands extending laterally between the layers.

3. A protective vest according to claim 2, in which apertures of the honeycombs have effective diameters approximately equal to a lateral separation between the inner and outer layer.

4. A protective vest according to claim 1, including pockets formed in the vest for slidingly receiving the impact modules.

5. A protective vest according to claim 1, including three modules respectively for left and right side lumbar regions of a sailor's body and a central spine region of the vest.

6. A protective vest according to claim 4, including a single belt for holding the three modules in position in respective pockets of the vest.

7. A protective vest according to claim 6, including a single belt for holding the three modules in position in respective pockets of the vest.

8. A protective vest having significant regions of externally exposed padding comprising an open sieve mattress formed of resilient water-resistant strands, in which the mattress is generally planar and comprises inner and outer woven honeycombed layers joined together by a plurality of strands extending laterally between the layers, and removable rigid impact modules for reinforcing the vest underneath the exposed padding, said modules including three modules respectively for left and right side lumbar regions of a sailor's body and a central spine region of the vest.

* * * * *